US005133110A

United States Patent [19]

Temburg

[11] Patent Number: 5,133,110

[45] Date of Patent: Jul. 28, 1992

[54] BALE OPENER HAVING A HORIZONTALLY TRANSVERSELY RECIPROCATING OPENING DEVICE AND HOUSING

[75] Inventor: Josef Temburg, Jüchen, Fed. Rep. of Germany

[73] Assignee: Trützschler GmbH & Co. KG, Monchengladbach, Fed. Rep. of Germany

[21] Appl. No.: 733,433

[22] Filed: Jul. 22, 1991

Related U.S. Application Data

[63] Continuation-in-part of Ser. No. 570,877, Aug. 22, 1990, Pat. No. 5,090,090.

[30] Foreign Application Priority Data

Aug. 31, 1989 [DE] Fed. Rep. of Germany ..... 3928835

[51] Int. Cl.[5] ..... D01G 7/04; D01G 7/12

[52] U.S. Cl. ..... 19/80 R; 19/145.5

[58] Field of Search ..... 19/80 R, 81, 105, 145.5

[56] References Cited

U.S. PATENT DOCUMENTS

| | | | |
|---|---|---|---|
| 3,951,282 | 4/1976 | Keller | 19/80 R X |
| 4,043,464 | 8/1977 | Keller et al. | 19/145.5 X |
| 4,281,437 | 8/1981 | Marx | 19/80 R |
| 4,357,737 | 11/1982 | Marx | 19/80 R |
| 4,363,585 | 12/1982 | Keller et al. | 19/80 R X |
| 4,493,131 | 1/1985 | Dragagna et al. | 19/80 R |
| 4,514,881 | 5/1985 | Hergeth et al. | 19/80 R |
| 4,660,257 | 4/1987 | Binder et al. | 19/80 R |
| 4,707,888 | 11/1987 | Binder et al. | 19/80 R |
| 4,993,117 | 2/1991 | Pinto et al. | 19/80 R |

FOREIGN PATENT DOCUMENTS

| | | | |
|---|---|---|---|
| 0394856 | 10/1990 | European Pat. Off. | 19/80 R |
| 1207625 | 9/1986 | Japan | 19/80 R |
| 2236121 | 3/1991 | United Kingdom | 19/80 R |

*Primary Examiner*—Werner H. Schroeder
*Assistant Examiner*—Ismael Izaguirre
*Attorney, Agent, or Firm*—Spencer, Frank & Schneider

[57] ABSTRACT

A bale opener for detaching fiber tufts from top faces of fiber bales includes a tower for travelling along a fiber bale series in a direction of travel; a cantilever housing supported on, and projecting laterally from the tower; an opening roll supported for rotation in the cantilever housing and being oriented horizontally and transversely to the direction of travel; and a displacing mechanism for displacing the cantilever housing and the opening roll as a unit horizontally relative to the tower, in a direction transverse to the direction of travel.

8 Claims, 1 Drawing Sheet

BALE OPENER HAVING A HORIZONTALLY TRANSVERSELY RECIPROCATING OPENING DEVICE AND HOUSING

CROSS REFERENCE TO RELATED APPLICATIONS

This application is a continuation-in-part of application Ser. No. 07/570,877, filed Aug. 22nd, 1990, which is now U.S. Pat. No. 5,090,090, Feb. 25,1992.

This application also claims the priority of Federal Republic of Germany Application No. P 39 28 835.8 filed Aug. 31st, 1989, which is incorporated herein by reference.

BACKGROUND OF THE INVENTION

1. FIELD OF THE INVENTION

This invention relates to a bale opener, particularly a travelling bale opener which is propelled back and forth along a series of fiber bales and which has an opening device proper that detaches fiber tufts from the top bale surfaces the bale opener travels.

2. DESCRIPTION OF THE RELATED ART

The opening device has at least one rapidly rotating opening or detaching roll supported horizontally in a downwardly open housing which is mounted on a bale opener tower and which, in cantilever fashion, projects horizontally laterally of the tower, in a direction transverse to the travelling (working) direction of the bale opener. As the height of the fiber bales is reduced during the fiber tuft detaching operation, the cantilever housing, together with the opening device, is periodically moved downwardly with respect to the tower of the bale opener to maintain the opening roll (or opening rolls) in engagement with the bale surfaces.

The opening roll has a plurality of spikes or teeth (detaching elements) on its surface. The detaching elements form axially spaced groups; the detaching elements in each group are arranged circumferentially. Each group of detaching elements may be formed on the periphery of discs, axially spacedly secured to a core (hub) of the opening roll. Underneath the opening roll or opening rolls a grate may be positioned which is formed of a plurality of spaced grate bars oriented parallel to the direction of travel (working direction) of the bale opener. The grate bars which extend in the space between adjoining groups of detaching elements, engage the top fiber bale surfaces and thus stabilize the fiber bales.

As the opening device is moved along the fiber bales and the detaching operation is in progress, in the upper bale surfaces side-by-side extending alternating furrows and ridges are formed, due to the spacing between the groups of detaching elements of the opening roll. Such ridges can be ablated only with difficulty, because the detaching elements do not reach the ridges formed of the compressed fiber material. Rather, the material which forms the ridges is torn out by being entrained by the fiber material engaged directly by the detaching elements. The ridges may be removed only gradually in several passes of the bale opener.

To provide for a more rapid elimination of the ridges and furrows during the detaching operation, it has been known to periodically shift the opening roll, relative to its supporting housing, in a horizontal direction, transversely to the working direction, to an extent which at least approximately equals one-half the axial center-to-center distance between adjoining groups of detaching elements. In case a grate is provided, the grate and the opening roll reciprocate as a unit. Such a construction is disclosed, for example, in U.S. Pat. No. 4,281,437, issued Aug. 4, 1981.

In the solution according to the described prior art, a horizontal, transverse, axial mobility of the opening roll proper relative to its supporting housing has to be provided. Such arrangements are particularly complex if, for example, several parallel-arranged opening (detaching) rolls are provided.

SUMMARY OF THE INVENTION

It is an object of the invention to provide an improved apparatus for removing furrows from the top bale surfaces by changing the working path of the opening roll teeth by a transverse, horizontal periodic shifting of the opening roll or rolls. It is a further object to significantly simplify the construction for achieving such a transverse, horizontal shifting motion.

This object and others to become apparent as the specification progresses, are accomplished by the invention, according to which, briefly stated, the downwardly open housing which accommodates the detaching roll or rolls is movable horizontally, in a direction transverse to the working direction (that is, transverse to the direction of bale opener travel) as a unit with the opening roll or rolls mounted in the housing. Thus, stated differently, while in the prior art arrangement the detaching roll was mounted for horizontal transverse reciprocation relative to the housing, such a transverse horizontal displacement of the detaching roll or rolls is effected by displacing the housing itself.

In accordance with a preferred embodiment of the invention, a motor is periodically energized to effect a transverse, horizontal shift of the housing, together with the opening roll and/or opening rolls and/or grates as a unit, relative to the tower. Such a motion is effected, for example, by a crank attached to the motor which, in each instance, is rotated through a predetermined angle, so that in consecutive operations the housing is alternately shifted back and forth.

DESCRIPTION OF THE PREFERRED EMBODIMENT

Figure 1:
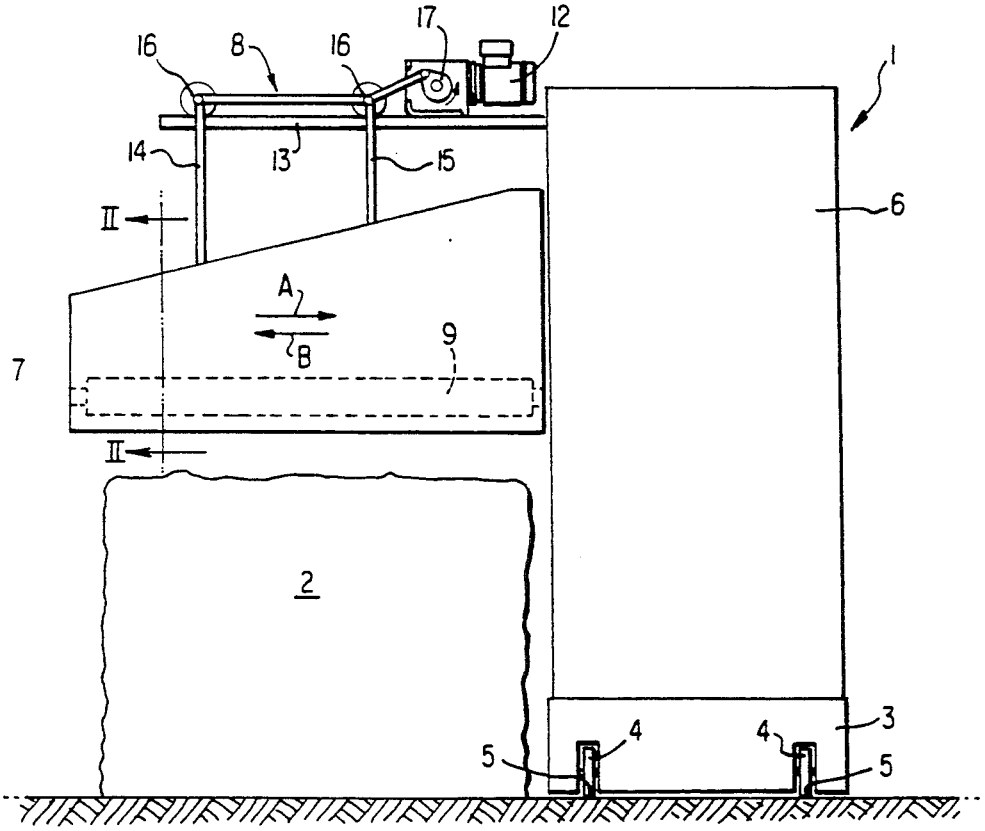
FIG. 1 is a schematic front elevational view of a bale opener incorporating a preferred embodiment of the invention.
Figure 2:
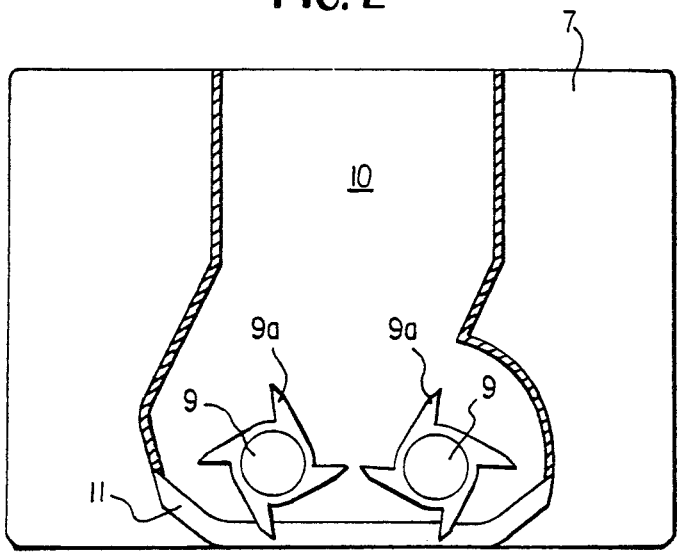
FIG. 2 is a partially sectional schematic side elevational view taken along line II—II of FIG. 1, shown on an enlarged scale relative to FIG. 1.

Turning to FIGS. 1 and 2, there is illustrated therein a bale opener generally designated at 1 for removing fiber tufts from the top faces of serially arranged fiber bales 2 (only one is visible) as the bale opener travels therealong. The bale opener comprises a carriage 3 whose wheels 4 run on rails 5 secured to the ground. The direction of travel of the bale opener 1 is perpendicular to the plane of the drawing FIG. 1.

A tower 6 which is mounted on the carriage 3 for travelling therewith as a unit supports a cantilever housing 7 by means of a beam assembly generally designated at 8.

In the downwardly open cantilever housing 7, at its lower portion thereof, two opening or detaching rolls 9 are supported in a horizontal orientation perpendicular to the direction of travel of the bale opener.

As the bale opener 1 travels on the rails 5 along the series of fiber bales 2, the opening rolls 9, rotated rapidly by a non-illustrated motor, detach fiber tufts from the upper bale surfaces and throw the fiber tuft into a suction hood 10 provided in the cantilever housing 7. A non-illustrated suction arrangement generates an upwardly oriented air stream in the suction hood 10 for pneumatically removing the detached fiber tufts from the bale opener 1.

As the height of the fiber bales decreases by virtue of the fiber tuft removal, the housing 7 is periodically lowered relative to the bale opener tower 6.

Figure 3:
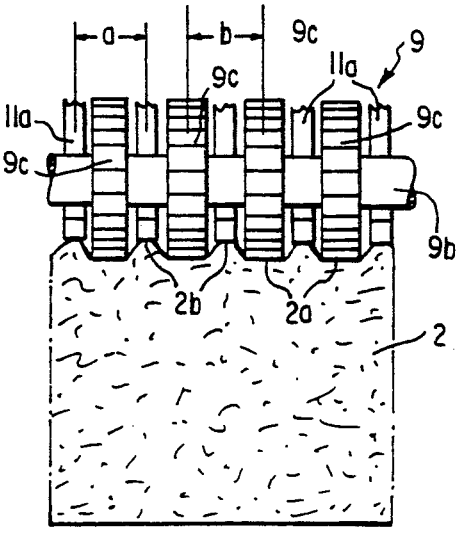
FIG. 3 is a schematic fragmentary front elevational view of an opening roll and a grate of the bale opener, on an enlarged scale relative to FIG. 1.

Turning to FIG. 3, each opening roll 9 has a shaft **9*b* to which a plurality of axially spaced toothed discs 9*c* are secured. In each space defined between adjoining toothed discs 9*c* separate grate bars 11*a* extend which together form a conventional grate 11 secured to the cantilever housing 7** in a manner not shown.

As a working pass of the bale opener 1 is in progress, the axially spaced, circumferential tooth groups on discs **9*c* form furrows 2*a* in the fiber bales 2, alternating, as viewed transversely to the direction of travel, with ridges 2*b* formed between adjoining roll discs 9*c***.

Reverting to FIG. 1, according to the invention, in order to remove the ridges **2*b* to thus equalize the top surface of the fiber bales as the detaching operation is in progress, the cantilever housing 7 is, in a controlled manner, displaceable periodically and alternatingly, in the directions A and B with respect to the tower 6, together with the opening rolls 9 and the grate 11 as a unit. The amount of each displacement preferably corresponds to one-half of the center-to-center distance a between two adjoining grate bars 11*a* or to one-half of the center-to-center distance b between two adjoining roll discs 9*c* to thus ensure that ridges 2*b* which have been built up during a previous working pass or working passes will be ablated to thus equalize the top bale surfaces. A transverse horizontal displacement of the cantilever housing 7, together with the opening rolls 9 and the grate 11** may take place, for example, after each working pass or a desired number of working passes.

The transverse horizontal displacement of the cantilever housing 7 may be effected by an eccentric drive assembly which includes an electric motor 12 mounted on a horizontal beam 13 forming part of the beam assembly 8 and held by the tower 6. The cantilever housing 7 is suspended from the horizontal beam 13 by means of vertical beams 14, 15 which also form part of the beam assembly 8 and which, at their upper ends, carry wheels 16 that are supported on a top running surface of the horizontal beam 13. The motor 12 drives a crank mechanism 17 which is connected to the movable assembly comprising the components 14, 15, 16. By means of an appropriate conventional control, triggered, for example, by non-illustrated limit switches energized at the end of a working pass, the motor 12 causes the crank mechanism 17 to rotate through a predetermined angle whereupon the cantilever hood 7 is displaced alternatingly in the one or the other direction A, B to an extent a.

It will be understood that the above description of the present invention is susceptible to various modifications, changes and adaptations, and the same are intended to be comprehended within the meaning and range of equivalents of the appended claims.

What is claimed is:

1. In bale opener for detaching fiber tufts from top faces of fiber bales, including a tower for travelling along a fiber bale series in a direction of travel; a cantilever housing supported on, and projecting laterally from the tower; an opening roll supported for rotation in the cantilever housing and being oriented horizontally and transversely to the direction of travel; the improvement comprising displacing means for displacing said cantilever housing and said opening roll as a unit horizontally relative to said tower, in a direction transverse to the direction of travel.

2. A bale opener as defined in claim 1, wherein said displacing means comprises (a) mounting means for mounting said cantilever housing on said tower and for providing for said horizontal displacing motion of said cantilever housing relative to said tower in a direction transverse to the direction of travel; and (b) a motor operatively connected to said cantilever housing for effecting said displacing motion thereof.

3. A bale opener as defined in claim 2, wherein said mounting means comprises (a) a horizontal beam carried by said tower and extending therefrom, in a direction transverse to said direction of travel; said horizontal beam having a running face; and (b) suspension means for suspending said cantilever housing from said horizontal beam; said suspension means including a wheel for travel on said running face.

4. A bale opener as defined in claim 3, further comprising connecting means for coupling a rotary output of said motor with said suspension means for effecting said displacing motion of said cantilever housing.

5. A bale opener as defined in claim 1, further comprising a grate supported in said housing and extending below said roll for engaging top surfaces of the fiber bales; said grate, said opening roll and said cantilever housing being movable as a unit by said displacing means.

6. A bale opener as defined in claim 5, wherein said opening roll has a plurality of fiber tuft detaching teeth; said teeth being arranged in groups; each group being formed of teeth arranged generally circularly about a circumference of the opening roll and adjoining groups being axially spaced from one another to define clearances; said grate being formed of spaced grate bars extending in said clearances.

7. A bale opener as defined in claim 6, wherein said displacing means includes means for displacing said cantilever housing, said opening roll and said grate as a unit to an extent generally equalling one-half of a center-to-center distance between adjoining grate bars.

8. A bale opener as defined in claim 1, wherein said opening roll is a first opening roll; further comprising a second opening roll supported for rotation in the cantilever housing and extending parallel to said first opening roll; said first opening roll, said second opening roll and said cantilever housing being movable as a unit by said displacing means.

* * * * *